US007303437B2

(12) United States Patent
Nishide

(10) Patent No.: US 7,303,437 B2
(45) Date of Patent: Dec. 4, 2007

(54) CONNECTOR AND A METHOD OF ASSEMBLING IT

(75) Inventor: Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/474,620

(22) Filed: Jun. 26, 2006

(65) Prior Publication Data

US 2006/0292907 A1 Dec. 28, 2006

(30) Foreign Application Priority Data

Jun. 27, 2005 (JP) ..... 2005-186878

(51) Int. Cl.
*H01R 13/40* (2006.01)

(52) U.S. Cl. ..... 439/595

(58) Field of Classification Search ..... 439/595, 439/752, 596, 488, 701, 148, 912
See application file for complete search history.

(56) References Cited

U.S. PATENT DOCUMENTS 5,509,829 A * 4/1996 Saba ..... 439/752
6,123,574 A 9/2000 Matsuda et al.
6,527,583 B2 * 3/2003 Plate ..... 439/489
2001/0023147 A1 9/2001 Kashiyama et al.
2002/0086580 A1 7/2002 Kurimoto et al.

* cited by examiner

*Primary Examiner*—Alexander Gilman
(74) *Attorney, Agent, or Firm*—Gerald E. Hespos; Anthony J. Casella

(57) ABSTRACT

A front mask (70) can be held at a testing position located before a proper position with respect to a mounting direction of the front mask (70). At this testing position, parts of the front ends of connecting portions (28S) of smaller female terminals (26S) accommodated in smaller cavities (24S) located behind the corresponding smaller cavities (24S) with respect to the mounting direction are exposed in smaller terminal insertion openings (75S), and these smaller terminal insertion openings (75S) are used also as testing openings through which probes (80) for an electrical connection test are inserted. The front mask (70) also is formed with test openings (82) where parts of the front ends of the connecting portions (28S) of the smaller female terminals (26S) accommodated in the frontmost smaller cavities (24S) with respect to the mounting direction are exposed when the front mask (70) is at the testing position.

10 Claims, 18 Drawing Sheets

CONNECTOR AND A METHOD OF ASSEMBLING IT

BACKGROUND OF THE INVENTION

1. Field of the Invention

The invention relates to a connector and specifically improved portions where an electrical connection test is conducted.

2. Description of the Related Art

U.S. Pat. No. 6,123,574 discloses a female connector with a female housing that has a terminal accommodating portion. Cavities are formed side by side in the terminal accommodating portion and female terminals can be accommodated in the cavities. Each female terminal has a tubular connecting portion for receiving the tab of a mating male terminal. Testing probes can be brought into contact with the female terminals to check whether the female terminals are in the correct cavities. Specifically, each probe is inserted through a terminal insertion opening in the front of the cavity and into the connecting portion of the female terminal. Thus, each probe contacts part of a resilient contact piece in the connecting portion.

The above-described probes are attached to a testing jig or the like and are driven forward and backward through an insertion stroke by operating a lever. The resilient contact pieces can be deformed excessively and set permanently in fatigue if the probes are inserted too deep.

The invention was developed in view of the above to prevent damage to female terminals during an electrical connection test.

SUMMARY OF THE INVENTION

The invention relates a connector with a housing that has a terminal accommodating portion. Cavities are formed in the terminal accommodating portion, and female terminals are accommodated in the cavities. Each female terminal fitting has a connecting portion that is connectable with the tab of a mating male terminal. A front mask is mounted along the front surface of the terminal accommodating portion. Terminal insertion openings extend through the front mask and are dimensioned to receive the tabs of the male terminals. The front mask can be located at a proper position where the terminal insertion openings of the front mask align respectively with the cavities. The front mask also can be located at a testing position that is offset from the proper position. Parts of the front ends of the connecting portions of the female terminals in the cavities are exposed when the front mask is at the testing position. Thus, the terminal insertion openings can receive probes for an electrical connection test. The front mask also has an exclusive testing opening disposed so that a part of the front end of the connecting portion of the female terminal accommodated in the frontmost cavity with respect to the mounting direction is exposed when the front mask is at the testing position.

The electrical connection test can be carried out with the front mask temporarily at the testing position. More particularly, the front ends of the connecting portions of the female terminals are exposed in the cavities that are behind the terminal insertion openings that double as the testing openings, and in the cavity behind the exclusive testing opening. Thus, probes can be inserted into the terminal insertion openings, excluding the rearmost terminal insertion opening with respect to the mounting direction of the front mask. A probe also can be inserted into the exclusive testing opening. The inserted probes contact the front ends of the connecting portions of the female terminals to carry out the electrical connection test for the female terminals. The front mask then can be moved to the proper position so that the terminal insertion openings align with the corresponding cavities.

The probes contact only the front ends of the connecting portions of the female terminals. Thus, the probes will not enter the connecting portions and will not damage the resilient contact pieces in the connecting portions.

The front mask preferably forms part of the front walls of the cavities.

The front mask preferably is mounted in an arranging direction of the cavities.

The testing position preferably is located before the proper position with respect to the mounting direction.

The terminal insertion openings and the exclusive testing opening preferably have different front shapes. Accordingly, the number of the terminal insertion openings, i.e. the number of contacts, can be determined precisely from the external appearance.

Slanted guiding surfaces preferably are formed over at least part of the periphery of the terminal insertion openings.

The terminal insertion openings conventionally are formed directly in a front wall of the terminal accommodating portion. However, the mold for forming locks leave holes in the front wall with the conventional design and these holes communicate with the terminal insertion openings. Thus, slanted guiding surfaces cannot be formed over the entire periphery of the terminal insertion openings with the conventional design. However, the front mask of the connector of the subject invention is a separate part and the terminal insertion openings are in the front mask. The mold for forming locks does not leave holes in the front mask does. Jig insertion openings are formed in the front mask and receive a jig for unlocking the lock. The jig insertion openings may be spaced from the terminal insertion openings. Accordingly, the slanted guiding surfaces can be formed over substantially the entire periphery of the terminal insertion openings. Therefore the tabs of the mating male terminals can be guided and connected smoothly with the corresponding female terminals.

The front mask has at least one erroneous-assembling preventing portion engageable with a mating erroneous-assembling preventing portion on a connecting surface of a mating housing when the front mask is mounted at the proper position.

The housing is fit to the mating housing with the front mask at the proper position. The erroneous-assembling preventing portions engage if the two housings conform correctly to each other, and hence the housings can be connected completely. An attempt could be made to fit two housings together while one housing is inverted. Alternatively, an attempt could be made to connect two housings having different specifications. In these situations, the erroneous-assembling preventing portions cannot engage and the two housings cannot be connected. Thus, erroneous assembling can be detected.

The erroneous-assembling preventing portions cannot engage properly if the front mask is not at the proper position. Therefore, the mounted state of the front mask can also be detected.

A resilient plug preferably is mounted at a rear surface of the housing and is retained by a rear holder.

A movable member may be provided on the housing to display a cam action that assists connection of the housing with the mating housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
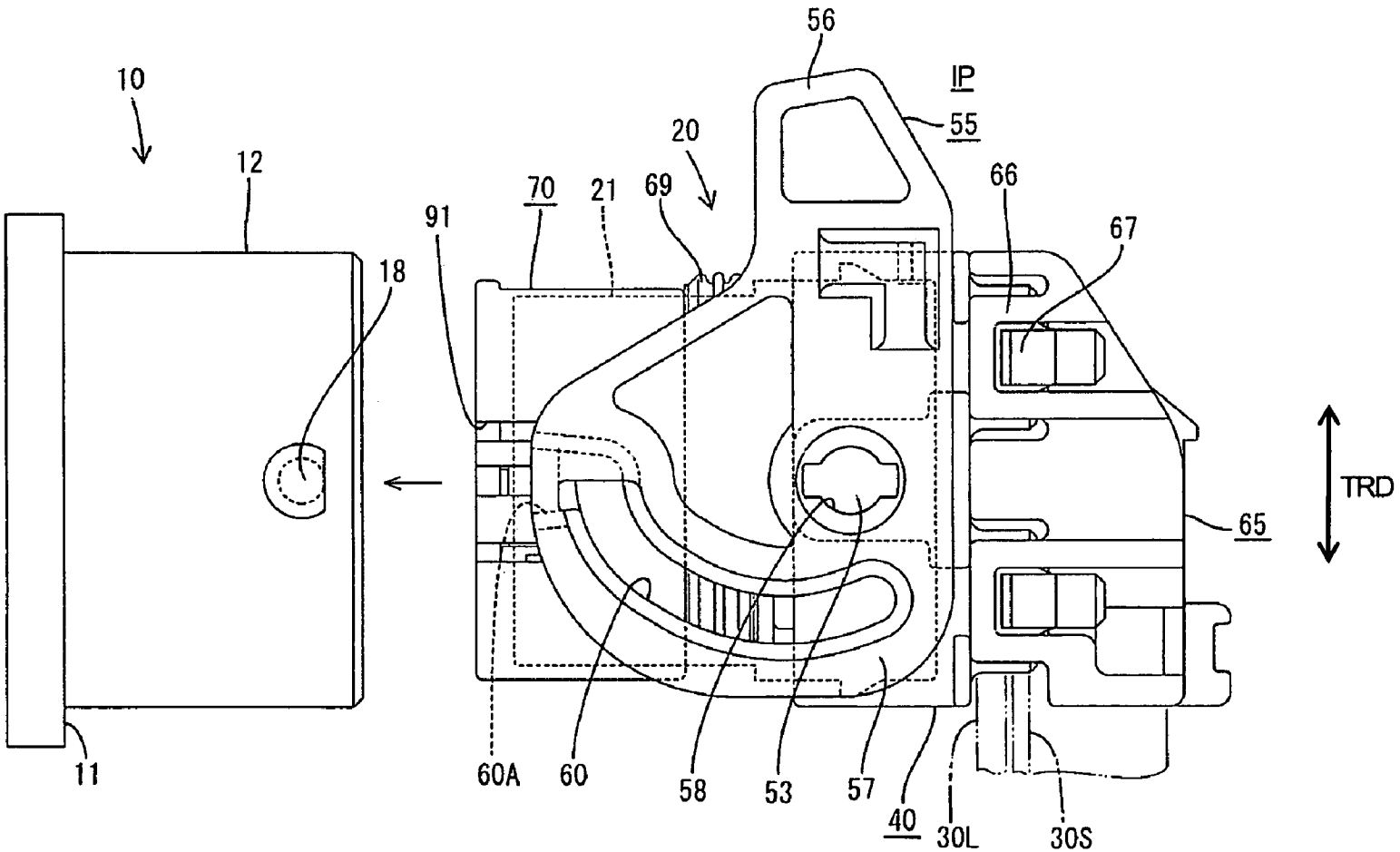
FIG. 1 is a bottom view showing a state before two housings according to one embodiment of the invention are connected.
Figure 2:
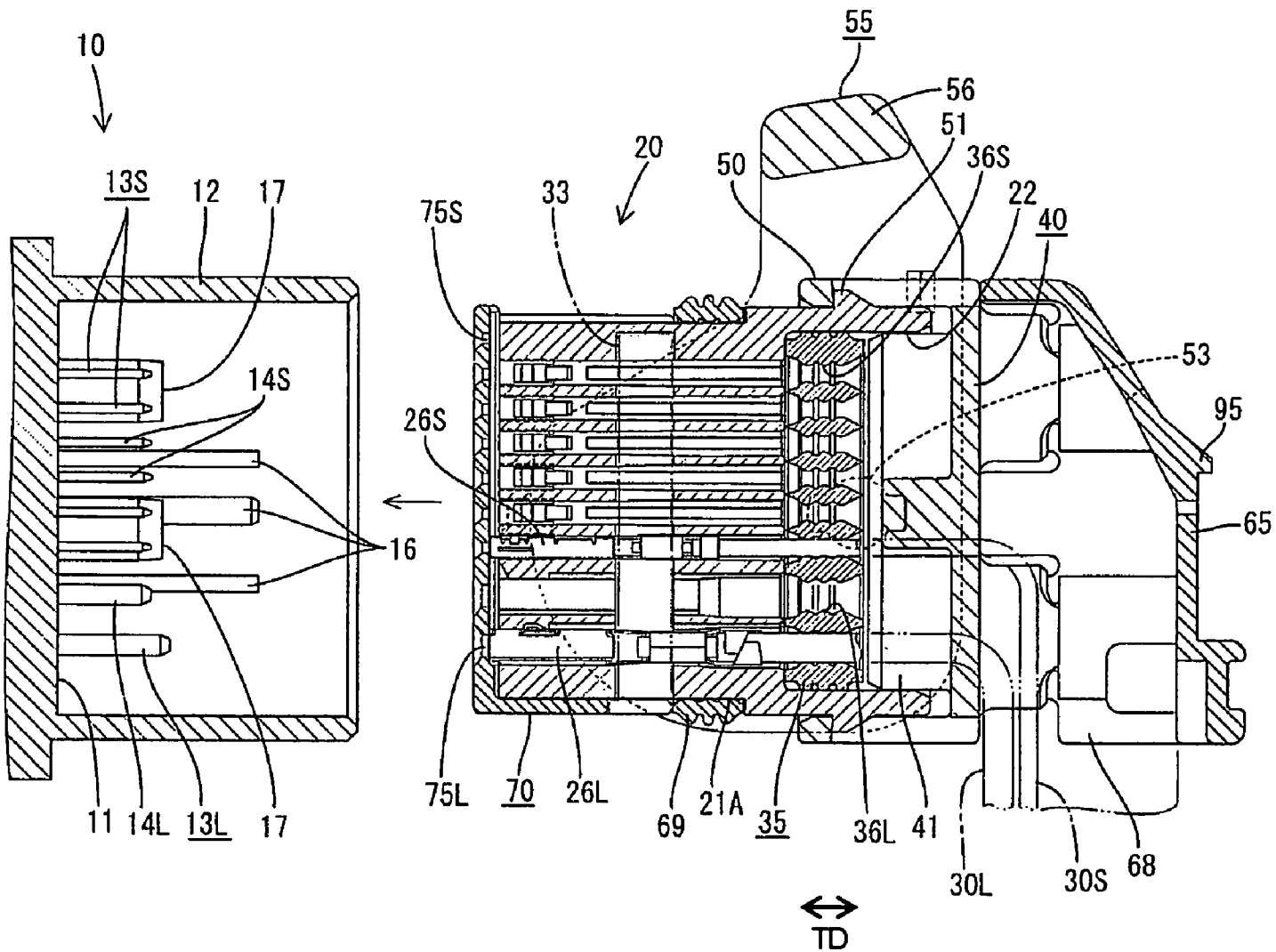
FIG. 2 is a section of the housings when viewed from below.

A lever-type watertight connector in accordance with the invention is illustrated in FIGS. 1 through 19. The connector has a male housing 10 and a female housing 20 that are connectable with each other as shown in FIGS. 1 and 2. Ends of the respective housings 10, 20 that are connected are referred to as the front ends in the following description.

The connector illustrated herein is a hybrid connector that has terminal fittings of different sizes accommodated in the same housing. Additionally, portions of the terminal fittings have different sizes and/or shapes. In the following description, the same reference numbers are given to common parts, but suffixes "L" or "S" are added to the reference numerals to distinguish the larger and smaller parts.

Figure 3:
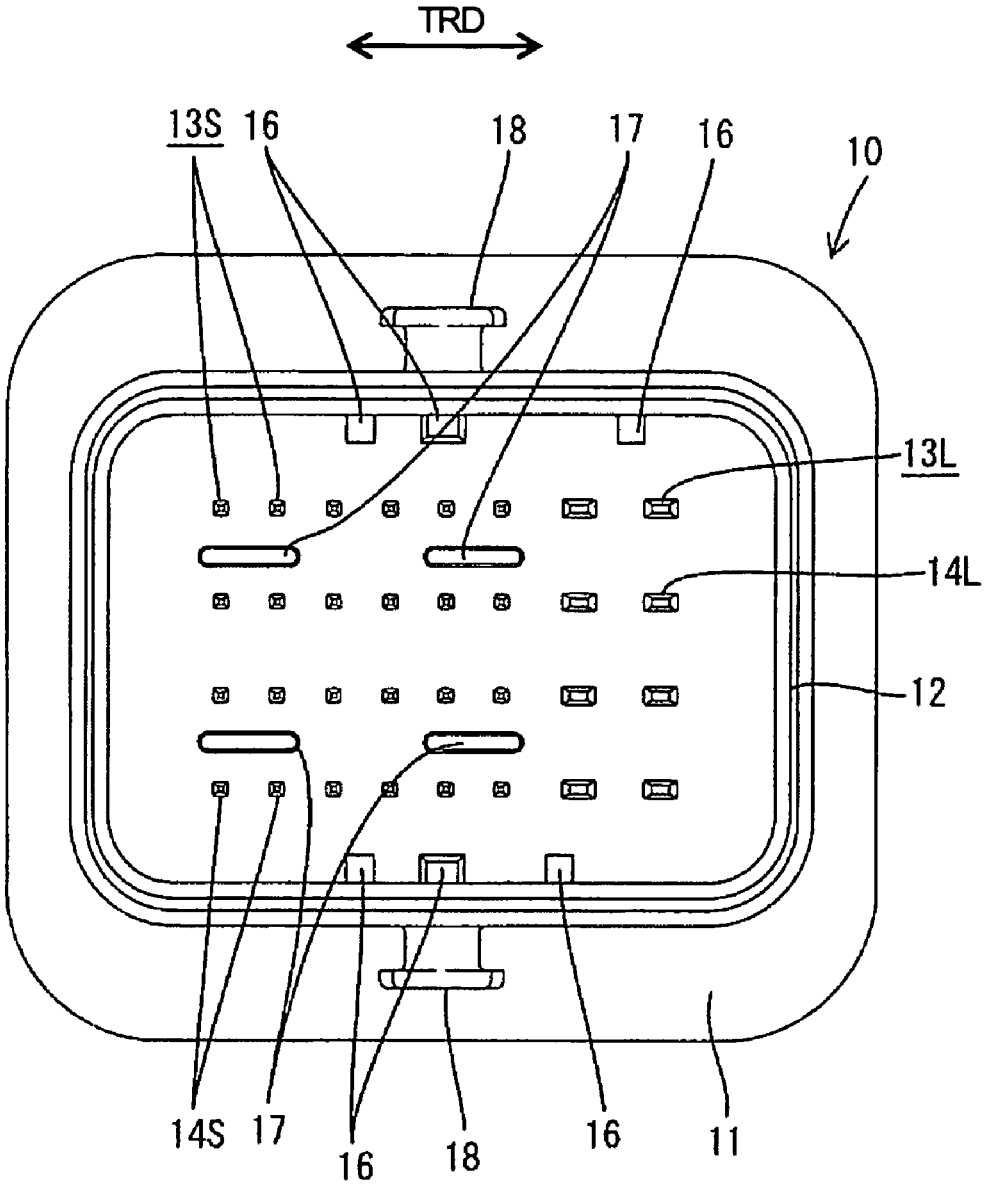
FIG. 3 is a front view of the male housing.

The male housing 10 of the illustrated embodiment is made of a synthetic resin and is connected directly with a casing 11 of a device. The male housing 10 is formed with a rectangular tubular receptacle 12 that projects from a wall of the device casing 11, as also shown in FIG. 3. Male terminals 13 are mounted in the male housing 10 and have tabs 14 that project in an array from the back surface of the receptacle 12. More specifically, the tabs 14L of the large male terminals 13L are arranged in two rows at four stages in an area close to the right side of the back surface of the receptacle 12 when viewed from front. The tabs 14S of the small male terminals 13S are arranged in six rows at four stages in an area stretching from a middle part to the vicinity of the left side. The respective tabs 14 preferably project up to a position of more than about half the depth, more preferably substantially ⅔ of the depth from the opening edge of the receptacle 12.

Guide ribs 16 extend along the ceiling and bottom surfaces from the back surface of the receptacle 12. The guide ribs 16 project to a position of less than about half the depth, and preferably about ⅓ the depth of the receptacle 12. Arrangements of the guide ribs 16 differ on the upper and lower sides.

Erroneous-connection preventing ribs 17 project from the back surface of the receptacle 12 for preventing an erroneous connection with the female housing 20. The erroneous-connection preventing ribs 17 are wide plates and project slightly longer than the tabs 14S at four corners of an area where the tabs 14S of the smaller male terminals 13S are arranged.

Two followers 18 project at widthwise center positions of upper and bottom outer surfaces of the receptacle 12 near the front end.

Figure 4:
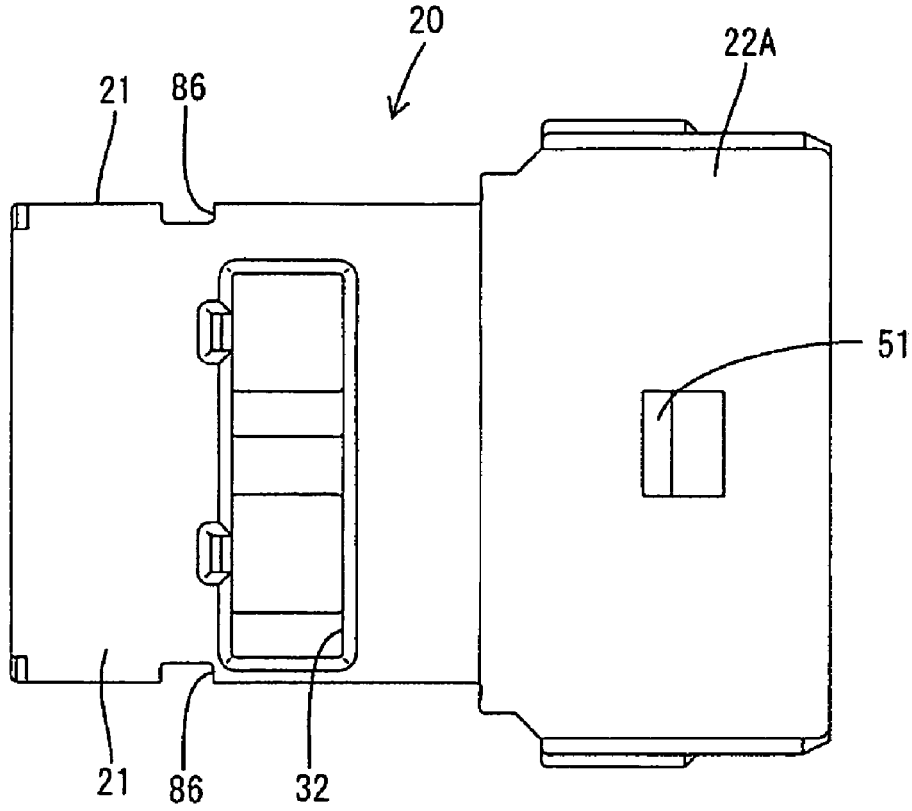
FIG. 4 is a side view of the female housing.
Figure 5:
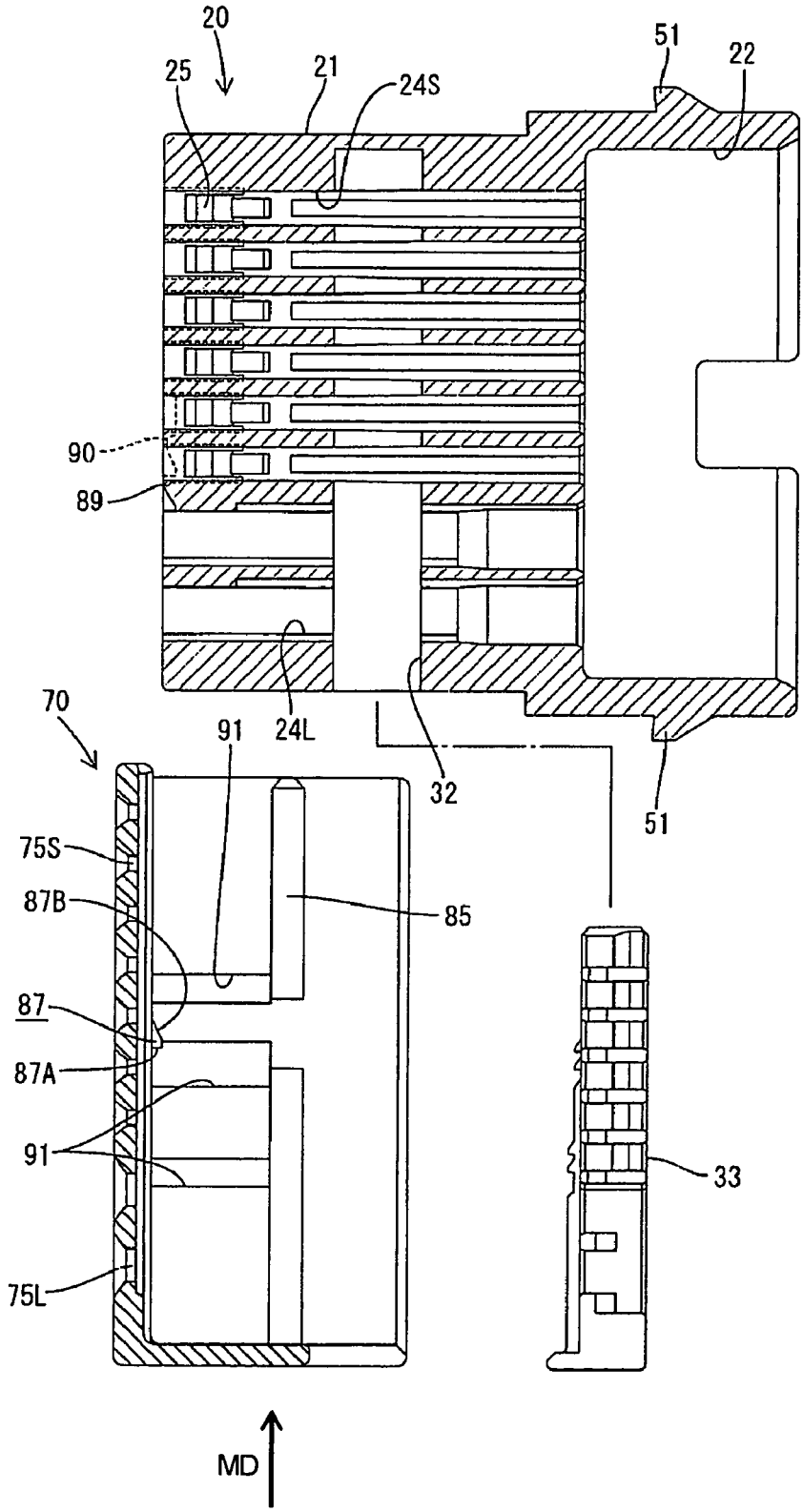
FIG. 5 is a section showing an operation of mounting a front mask and a retainer.

The female housing 20 is made e.g. of a synthetic resin and is in the form of a stepped block with a large rear end and a small front end, as shown in FIGS. 4 and 5. The front end of the female housing 20 is a terminal accommodating portion 21 and can fit closely into the receptacle 12 of the male housing 10. A mounting recess 22 having an open rear end is formed in the rear side of the female housing 20.

As described later, a front mask 70 for forming at least part of a front wall is mountable on the front of the terminal accommodating portion 21.

Figure 6:
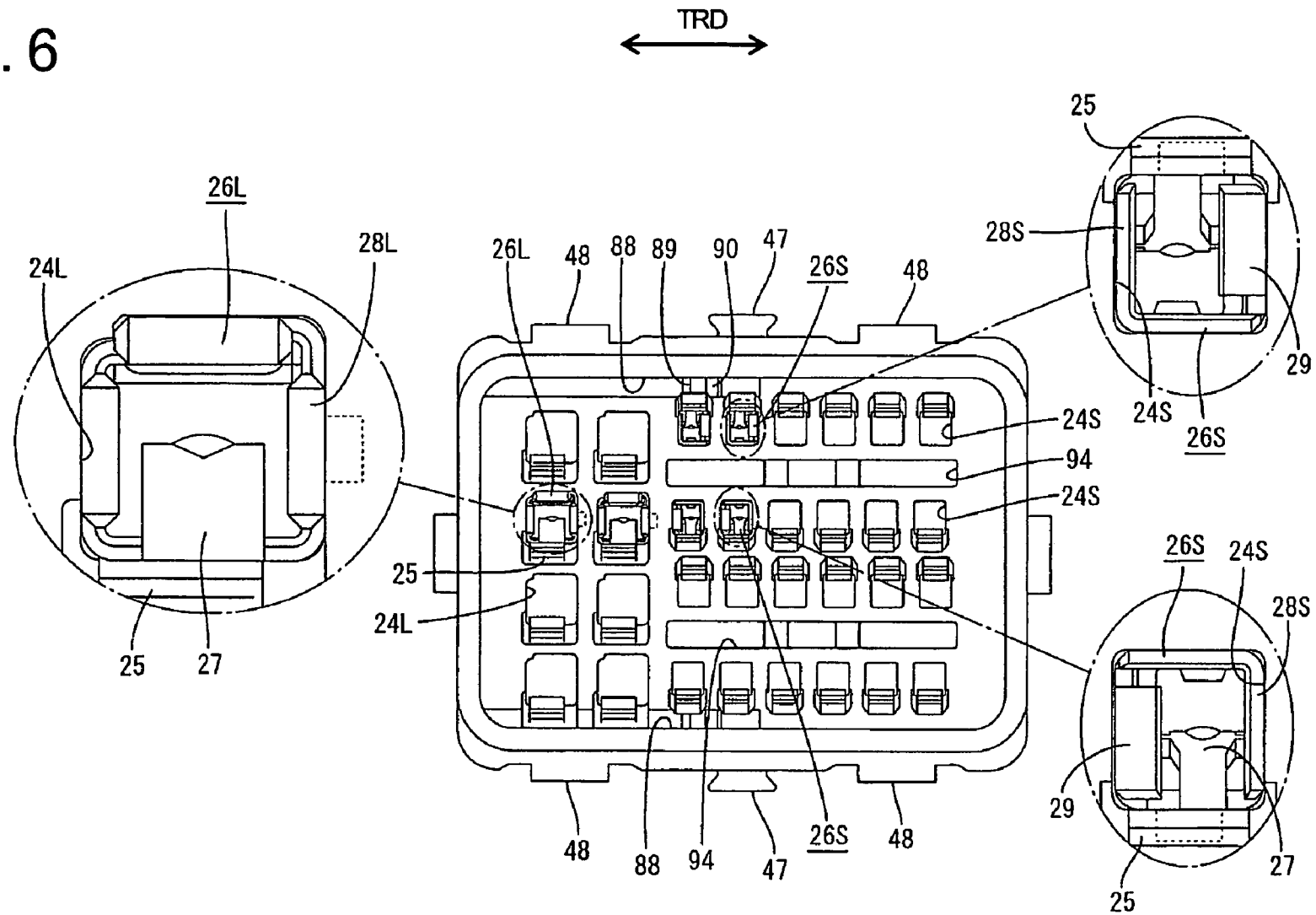
FIG. 6 is a front view of the female housing.

Cavities 24 penetrate the terminal accommodating portion 21 in forward and backward directions for accommodating female terminals 26. More specifically, as shown in FIG. 6, large cavities 24L are formed in two rows at four stages in an area close to the left side when viewed from the front and in positions corresponding to the tabs 14L of the large male terminals 13L in the male housing 10. The large cavities 24L accommodate the large female terminals 26L. Small cavities 24S for are formed in six rows at four stages in an area stretching from a substantially a middle part to the vicinity of the right side and in positions corresponding to the tabs 14S of the smaller male terminals 13S. The small cavities 24*s* accommodate the small female terminals 26S.

Locks 25 are formed at bottom sides of the large cavities 24L. On the other hand, the small cavities 24S at the lower two stages are in a back-to-back arrangement, and the small cavities 24S at the upper two stages also are in back-to-back arrangement. Locks 25 are provided at ceiling sides of the small cavities 24S at the upper stage in each group while being provided at bottom sides of the small cavities 24S at the lower stage in each group. In each group, the small cavities 24S at the upper stage are displaced slightly laterally with respect to those at the lower stage.

The large and small female terminals 26L and 26S each have a resilient contact piece 27 disposed respectively in a rectangular tubular connecting portion 28L, 28S. Each female terminal 26L, 26S is secured to an end of a wire 30. The resilient contact pieces 27 in the smaller female terminals 26S are displaced to the right when viewed from the front, and front plates 29 are bent substantially at right angles at the left edges of the connecting portions 28 to at least partly cover spaces between the resilient contact pieces 27 and the left edges.

The large female terminals 26L are inserted into the large cavities 24L from behind and are stopped at their front end positions by the front mask 70. The locks 25 lock the large female terminals 26L in the large cavities 24L. The small female terminals 26S are inserted either in a correct posture or an upside-down posture into the smaller cavities 24S from behind and are stopped at their front end positions by the front mask 70. The locks 25 lock the small female terminals 26L in the small cavities 24S (see FIGS. 10 and 11).

Figure 17:
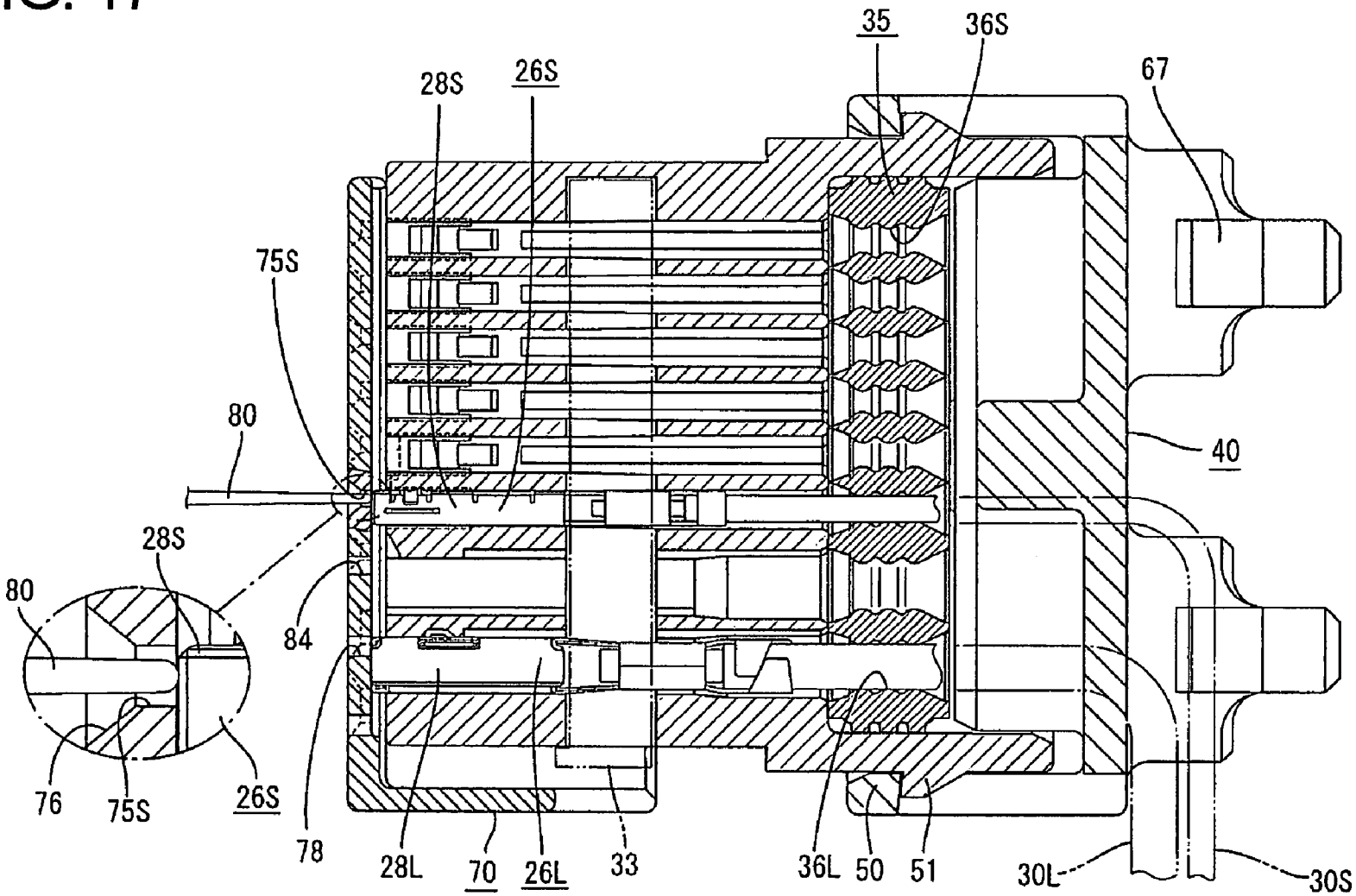
FIG. 17 is a section showing a state of the electrical connection test.
Figure 18:
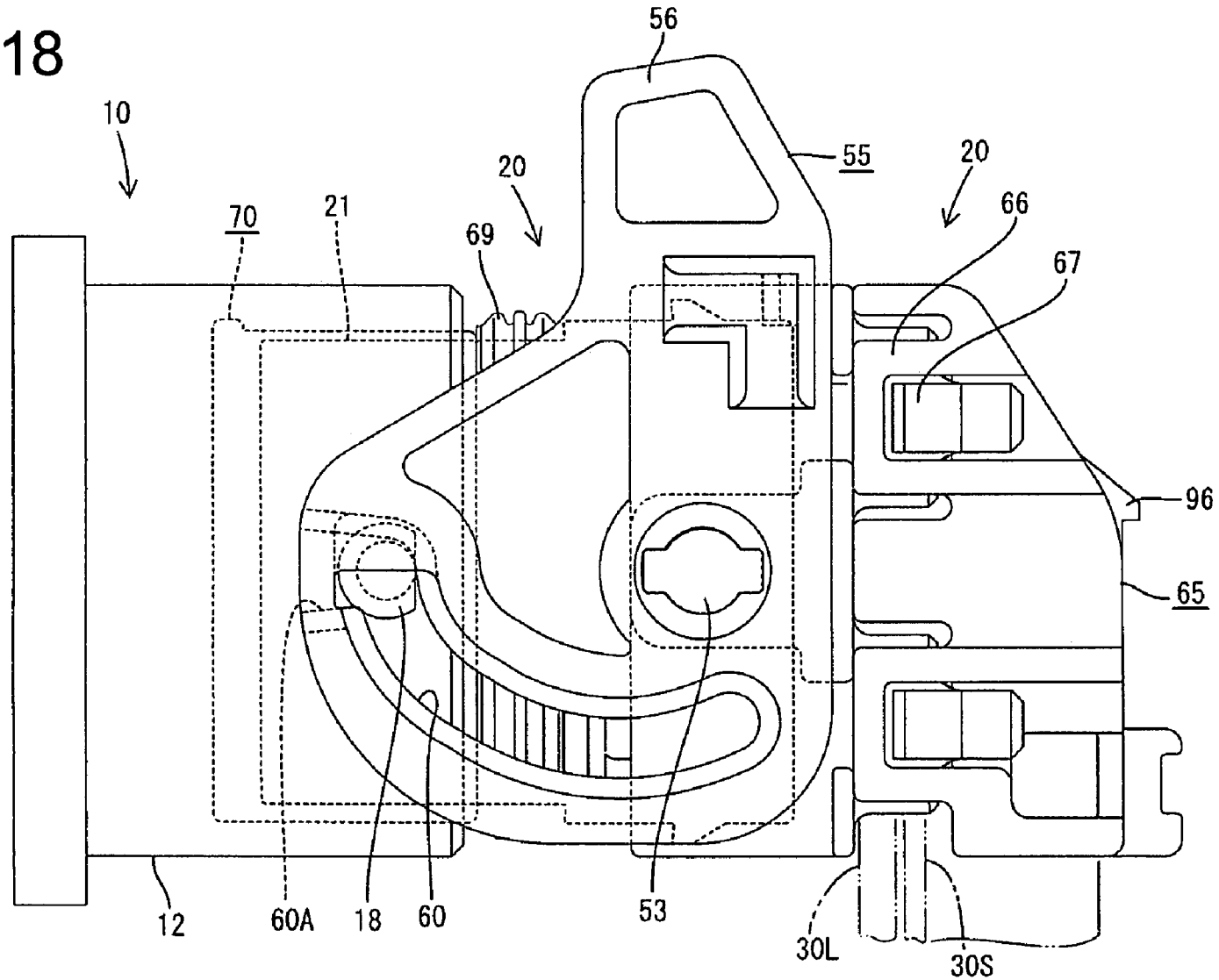
FIG. 18 is a bottom view showing a connection initial state of the two housings.

As shown in FIG. 5, a side-type retainer 33 is mountable into the terminal accommodating portion 21 through a retainer insertion opening 32 in a side surface of the terminal accommodating portion 21 and engages the jaws at the rear edges of the connecting portions 28 of the respective female terminals 26 for doubly retaining the female terminals 26 (see FIG. 17).

A one-piece rubber plug 35 is to be mounted in the mounting recess 22 at the rear of the female housing 20, and is retained by a rear holder 40. The one-piece rubber plug 35 is formed with wire insertion holes 36 through which the wires 30 secured to the female terminals 26 are closely inserted. The wire insertion holes 36 are arranged at positions corresponding to the cavities 24. As shown in FIG. 17, large and small wire insertion holes 36L, 36S formed so as to correspond to wires 30L, 30S having a large and small diameter.

Figure 10:
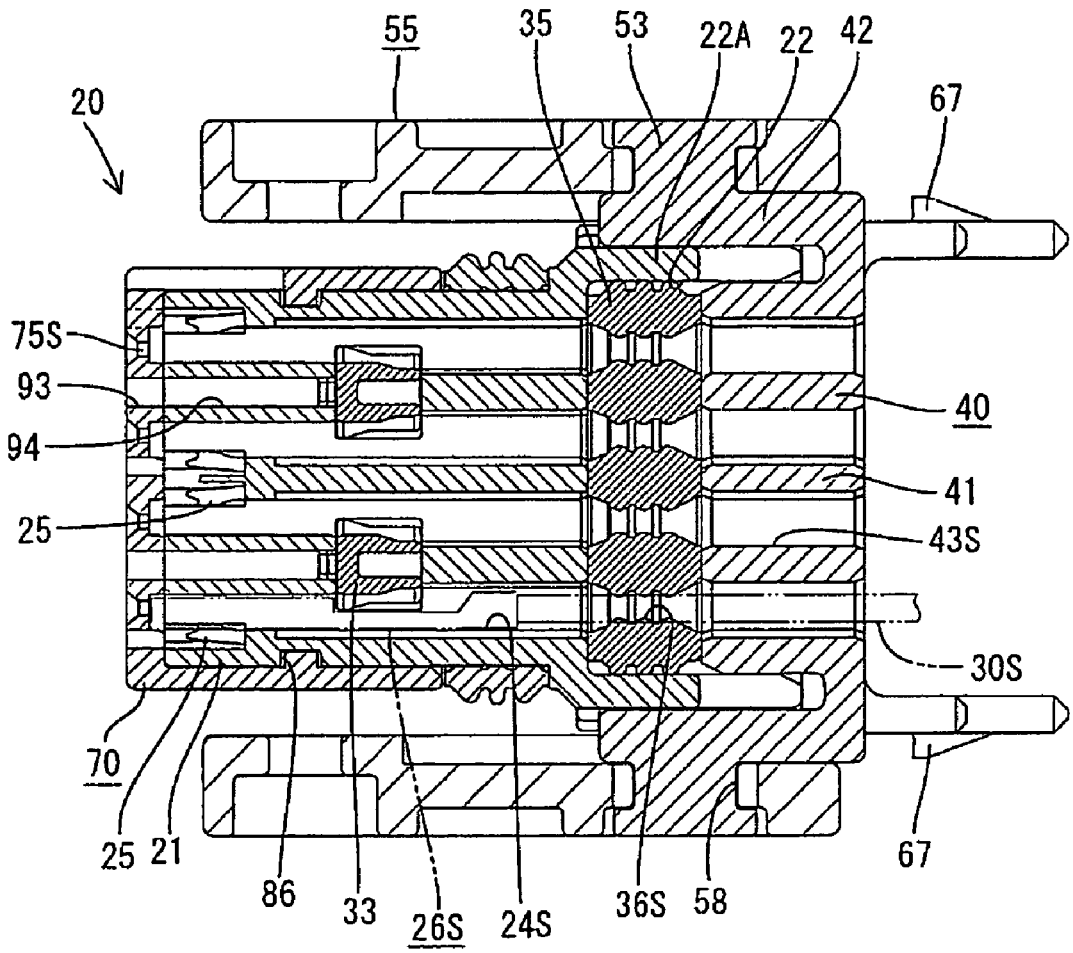
FIG. 10 is a side view in section showing a state where the front mask is mounted at a testing position.
Figure 11:
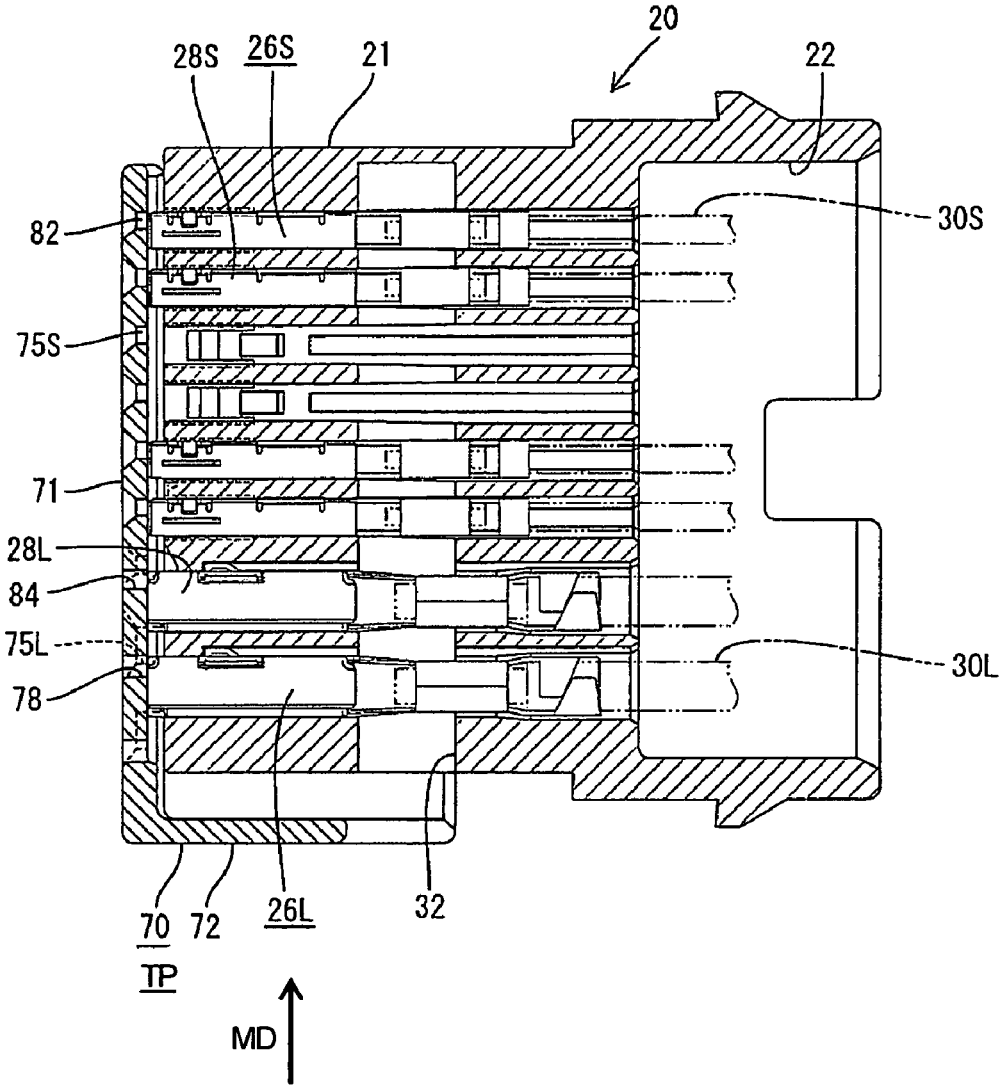
FIG. 11 is a section showing the state of FIG. 10 from below.

The rear holder 40 is made e.g. of a synthetic resin, and is closely fittable to the rear side of the mounting recess 22. The rear holder 40 includes a base 41 for pressing the rear surface of the one-piece rubber plug 35 and a tube 42 arranged around the base 41 and fittable onto an outer wall 22A of the mounting recess 22, as also shown in FIG. 10.

Figure 7:
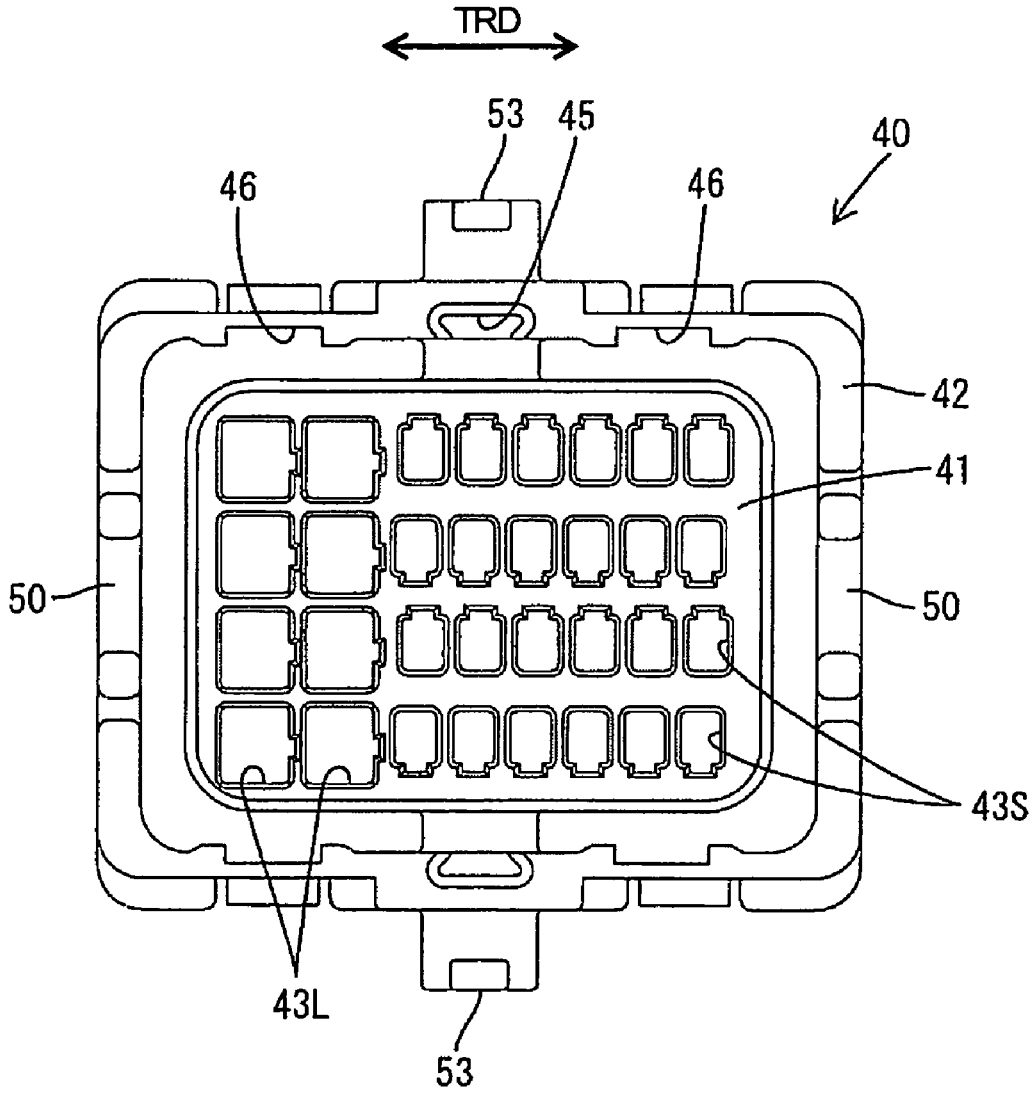
FIG. 7 is a front view of a rear holder.

Insertion paths 43L, 43S penetrate through the base 41 at positions corresponding to the wire insertion holes 36 of the one-piece rubber plug 35, as shown in FIG. 7, and both the large and small female terminals 26L, 26S can be inserted together with the wires 30L, 30S.

Dovetail grooves 45 are formed in the widthwise centers of the upper and lower inner wall surfaces of the tube 42 and the rear holder 40, and guide grooves 46 are formed at the opposite sides of the dovetail grooves 45 and extend in forward and backward directions. Dovetail projections 47 are formed on the upper and lower surfaces of the outer wall 22A of the mounting recess 22 of the female housing 20 and guide ribs 48 are formed at the opposite sides of the dovetail projections 47. Further, as shown in FIG. 2, two resiliently deformable locking frames 50 project forward from the left and right surfaces of the tube 42 of the rear holder 40. The tube 42 of the rear holder 40 can be fit to a specified depth onto the outer wall 22A of the mounting recess 22 of the female housing 20 and is guided by the engagement of the dovetail projections 47 and the dovetail grooves 45 and the engagement of the guide ribs 48 and the guide grooves 46. The locking frames can be engaged resiliently with locking projections 51 on the left and right surfaces of the outer wall 22A. Thus, the rear holder 40 is mounted so as not to be detached. At this locked position, the front surface of the base 41 of the rear holder 40 is located immediately after the rear surface of the one-piece rubber plug 35, and the rear holder 40 is movable forward from this locked position.

A lever 55 is mounted on the rear holder 40. The lever 55 is made e.g. of a synthetic resin and has a U-shape defined by an operable portion 56 and left and right side plates 57 that extend from opposite ends of the operable portion 56. Rotary shafts 53 extend symmetrically from the outer upper and lower surfaces of the tube 42 of the rear holder 40, and the lever 55 is supported rotatably by having the rotary shafts 53 fit into bearing holes 58 in the side plates 57.

A cam groove 60 having a specified curved configuration is formed in each side plate 57 of the lever 55 so that an entrance 60A of the cam groove 60 is at the outer peripheral edge of the side plate 57. The followers 18 on the male housing 10 are engageable with the cam grooves 60 to display a cam action.

The lever 55 is mounted at an initial position IP where the entrances 60A of the cam grooves 60 face forward as shown in FIG. 1. The female housing 20 is fit to the male housing 10 in this state. As a result, the followers 18 of the male housing 10 face the entrances 60A of the followers 18. The lever 55 can be rotated in the clockwise direction of FIG. 1. Thus, the followers 18 move along the cam grooves 60 and display a cam action for pulling the male and female housings 10 and 20 together. The lever 50 can be rotated further operated even after the two housings 10, 20 are connected completely. Therefore, the rear holder 40 moves further forward and the base portion 41 thereof compresses the rubber plug 35 in the thickness direction TD. In other words, the rotation stroke of the lever 55 exceeds the stroke required to connect the male and female housings 10, 20, preferably is a sum of the stroke required to connect the male and female housings 10, 20 and a stroke required to compress the rubber plug 35.

A wire cover 65 is mounted on the rear surface of the rear holder 40. The wire cover 65 is in the form of a cap having opening front and lateral surfaces. Although not described in detail, the wire cover 65 is mounted by resiliently engaging locking pieces 66 on each of the opposite side surfaces with interlocking portions 67 (see FIG. 10) at corresponding positions on the rear surface of the rear holder 40. The wires 30L, 30S drawn out through the rear surface of the rear holder 40 are bent and guided in the wire cover 65 and pulled out at an angle to the extension direction of the respective terminal fitting 26 (down in FIG. 2) through a draw-out opening 68.

Further, a housing seal 69 for providing sealing between the female housing 20 and the mating male housing 10 is to be mounted at a step 21A on the outer peripheral surface of the terminal accommodating portion 21.

The front mask 70 is mounted on the front surface of the terminal accommodating portion 21. The front mask 70 is made e.g. of a synthetic resin and is formed separate from the female housing 20.

Figure 8:
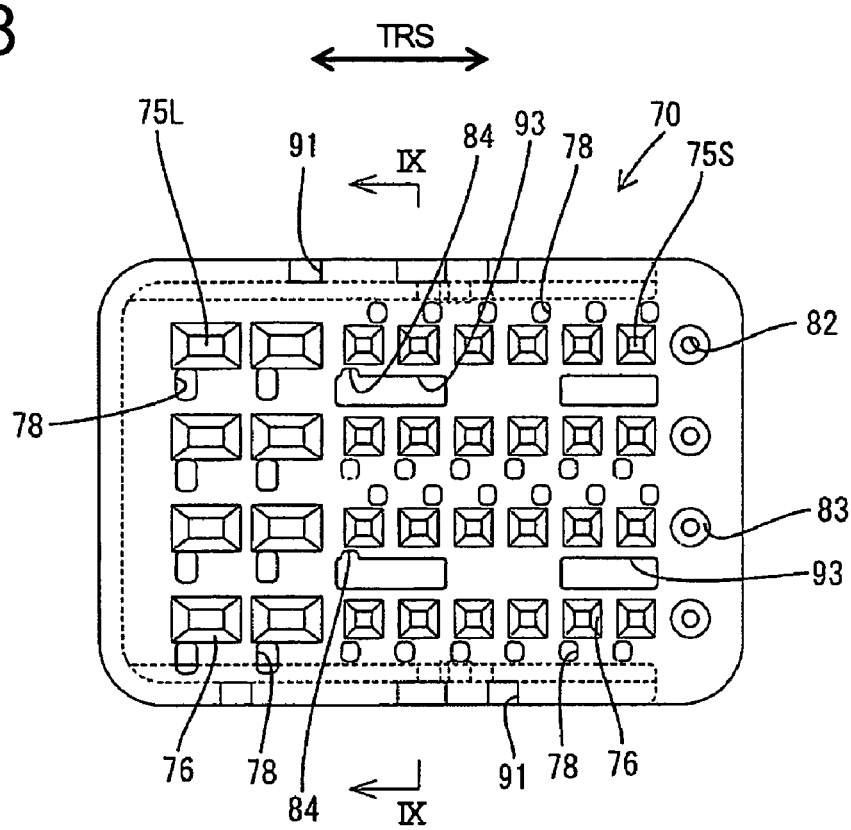
FIG. 8 is a front view of the front mask.
Figure 9:
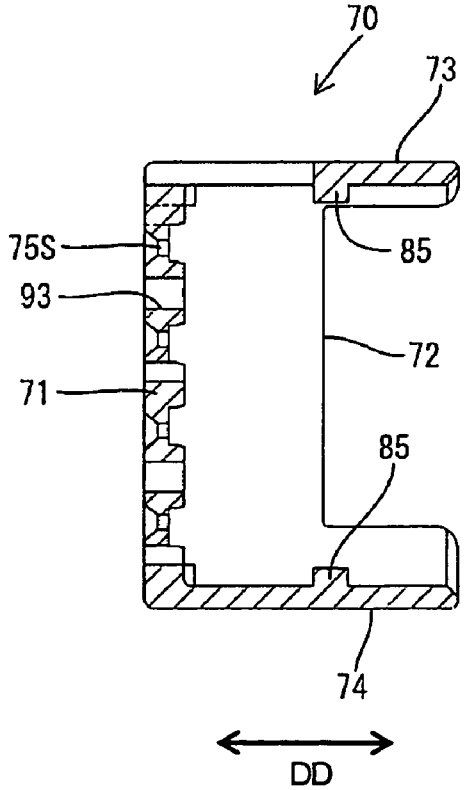
FIG. 9 is a section along IX-IX of FIG. 8.

As shown in FIGS. 8 and 9, the front mask 70 has a front plate 71 arranged to cover at least part of the front surface of the terminal accommodating portion 21. A side plate 72 projects back from the left edge of the front plate 71. Additionally, a ceiling plate 73 and a bottom plate 74 project back continuously from the upper and bottom ends of the front plate 71 and the side plate 72.

The front plate 71 has terminal insertion openings 75 at positions corresponding to the tabs 14 of the male terminals 13 of the male housing 10. The terminal insertion openings 75 communicate with the corresponding cavities 24 when the front mask 70 is mounted at a proper position PP. Accordingly, large terminal insertion openings 75L are formed in two rows at four stages in an area close to the left side of the front plate 71 when viewed from the front and have a wide rectangular shape to permit insertion of the tabs 14L of the large male terminals 13L. Small terminal insertion openings 75S are formed in six rows at four stages in an area stretching from a middle part to the vicinity of the opposite right side and have a smaller size and a square shape to permit insertion of the tabs 14S of the small male terminals 13S.

The respective stages of the terminal insertion openings 75 are at substantially constant intervals. More particularly, two large terminal insertion openings 75L are arranged at a specified interval and six smaller terminal insertion openings 75S are arranged at substantially even intervals along the transverse direction TRD. Additionally, the large terminal insertion opening 75L and the small terminal insertion opening 75S adjacent to each other are arranged at a specified interval.

Guiding surfaces 76 are formed at upper, lower, left and right edges of the terminal insertion openings 75L, 75S and taper the terminal insertion openings 75L, 75S towards the back.

The front plate 71 also has jig insertion openings 78 through which a jig can be inserted to deform the lock 25 in each cavity 24 in an unlocking direction. The jig insertion openings 78 for the large cavities 24L are at the left ends of the bottom edges of the large terminal insertion openings 75L. The jig insertion openings 78 for the small cavities 24S are at opposite right ends of the upper edges of the small terminal insertion openings 75S at the upper stages of two groups and at the left ends of the bottom edges of the small terminal insertion openings 75S at the lower stages of the two groups. One group consists of the first and second stages and the other group consists of the third and fourth stages.

The jig insertion openings 78 are at a distance from the terminal insertion openings 75. Thus, the guiding surfaces 76 are formed at all four edges of the respective terminal insertion openings 75.

The small terminal insertion openings 75S, other than those at the left ends of the stages in FIG. 8, double as testing openings that receive probes 80 for an electrical connection test (see FIG. 17). Further, testing openings 82 used exclusively to receive the probes 80 are at the right side of the small terminal insertion openings 75S at the right ends of the respective stages and are formed at the same intervals as rows of the small terminal insertion openings 75S. The testing openings 82 have a shape (e.g. round) different from the small terminal insertion openings 75S. Guiding surfaces 83 also are formed over substantially the entire periphery of the opening edges of the testing openings 82 to taper the testing openings 82 toward the back.

The jig insertion openings 78 for the large terminal insertion openings 75L at the right side are used as testing openings for the large female terminals 26L at the left side. The jig insertion openings 78 for the leftmost small terminal insertion openings 75S at the second and fourth stages are used as the testing openings for the large female terminals 26L at the right side of the second and fourth stages. Communicating openings 84 continuous with the left ends of the upper surfaces of rib insertion grooves 93 are used as the testing opening for the large female terminals 26L at the first and third stages.

The front mask 70 is mounted on the front surface of the terminal accommodating portion 21 laterally from the left side when viewed from the front. Thus, guide rails 85 extend substantially in the transverse direction TRD at substantially middle positions on facing surfaces of the ceiling plate 73 and the bottom plate 74 of the front mask 70 with respect to depth direction DD, as shown in FIG. 9. Guide grooves 86 are formed along substantially the entire width in the upper and bottom surfaces of the terminal accommodating portion 21 for guiding the guide rails 85 inserted therein, as shown in FIG. 10.

Engaging portions 87 project in the widthwise centers of the upper and bottom edges of the rear surface of the front plate 71, as shown in FIG. 5. The rear surface of each engaging portion 87 with respect to a mounting direction MD of the front mask 70 is an upright locking surface 87A and the front surface is a slanted guiding surface 87B. A slidable groove 88 is formed at each of the upper and lower edges of the front surface of the terminal accommodating portion 21 and extends from the left end to a widthwise middle for slidably receiving the corresponding engaging portion 87. A partial locking projection 89 and a full locking projection 90 are formed at the back of each slidable groove 88. The partial locking projection 89 is located before the full locking projection 90, as shown in FIG. 6.

The front mask 70 is mounted while the rear surface of the front plate 71 contacts the front surface of the terminal accommodating portion 21. The guide rails 85 slide along the respective guide grooves 86 and the engaging portions 87 slide along the respective slidable grooves 88. The engaging portions 87 then move over and engage the partial locking projections 89 (see FIGS. 11 and 12) to define a testing position TP of the front mask 70. The front mask 70 can be pushed farther so that the engaging portions 87 move over and engage the full locking projections 90 (see FIGS. 14 and 15) to define a proper position PP of the front mask 70.

Figure 12:
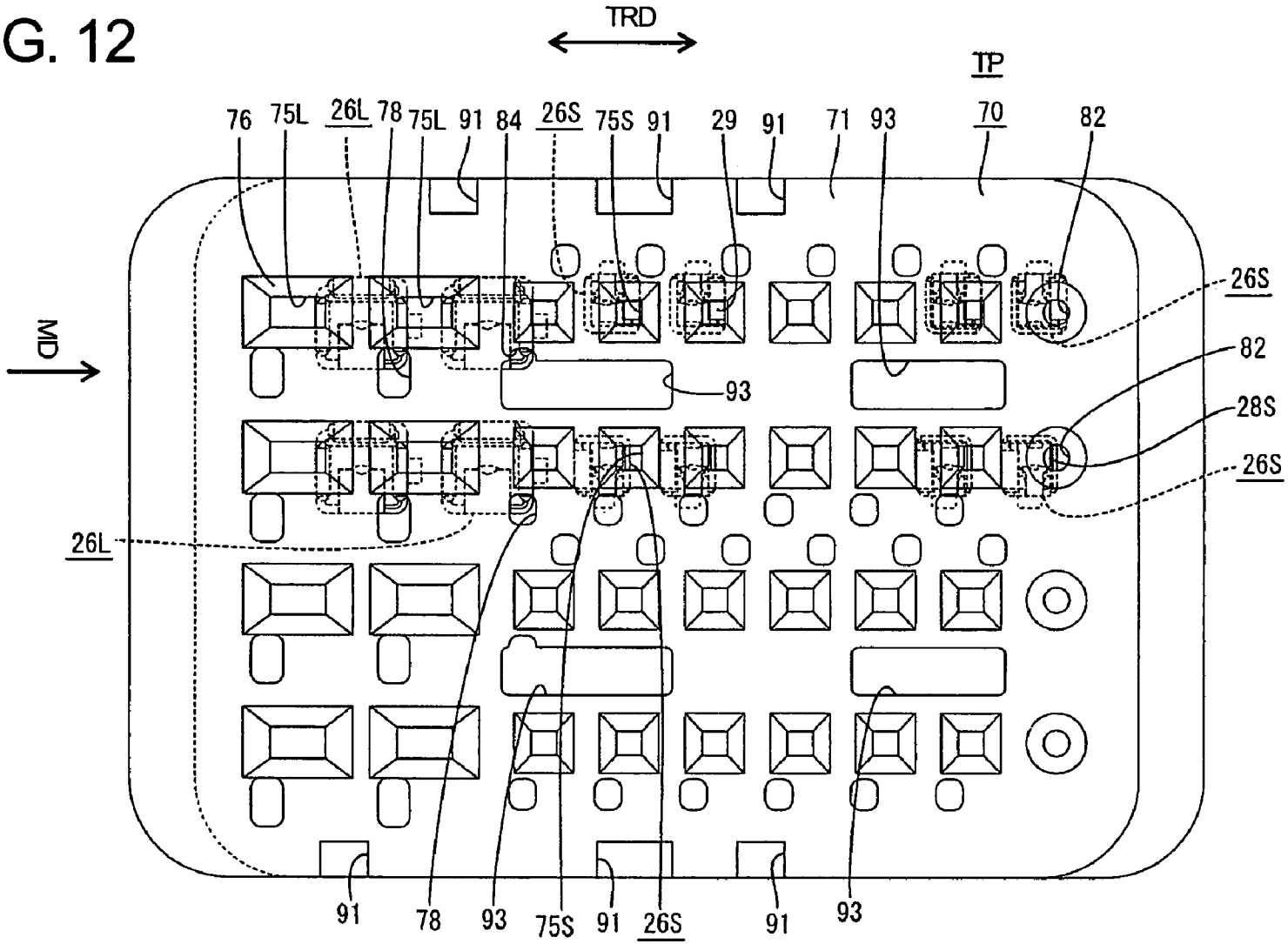
FIG. 12 is a front view showing the state of FIG. 10.

When the front mask 70 is at the testing position TP, a part of the front end of the connecting portion 28S of the small female terminal 26S in the cavity 24S behind the corresponding cavity 24S with respect to the mounting direction MD of the front mask 70 is exposed in each small terminal insertion opening 75S doubling as the testing opening, as shown in FIGS. 12 and 13. Further, a part of the front end of the connecting portion 28S of the small female terminal 26S in the frontmost cavity 24S with respect to the mounting direction MD is exposed in each exclusive testing opening 82.

The bottom right corner of the front end of the connecting portion 28L of each larger female terminal 26L is exposed in the jig insertion opening 78 or the communicating opening 84 to double as the testing opening.

Figure 15:
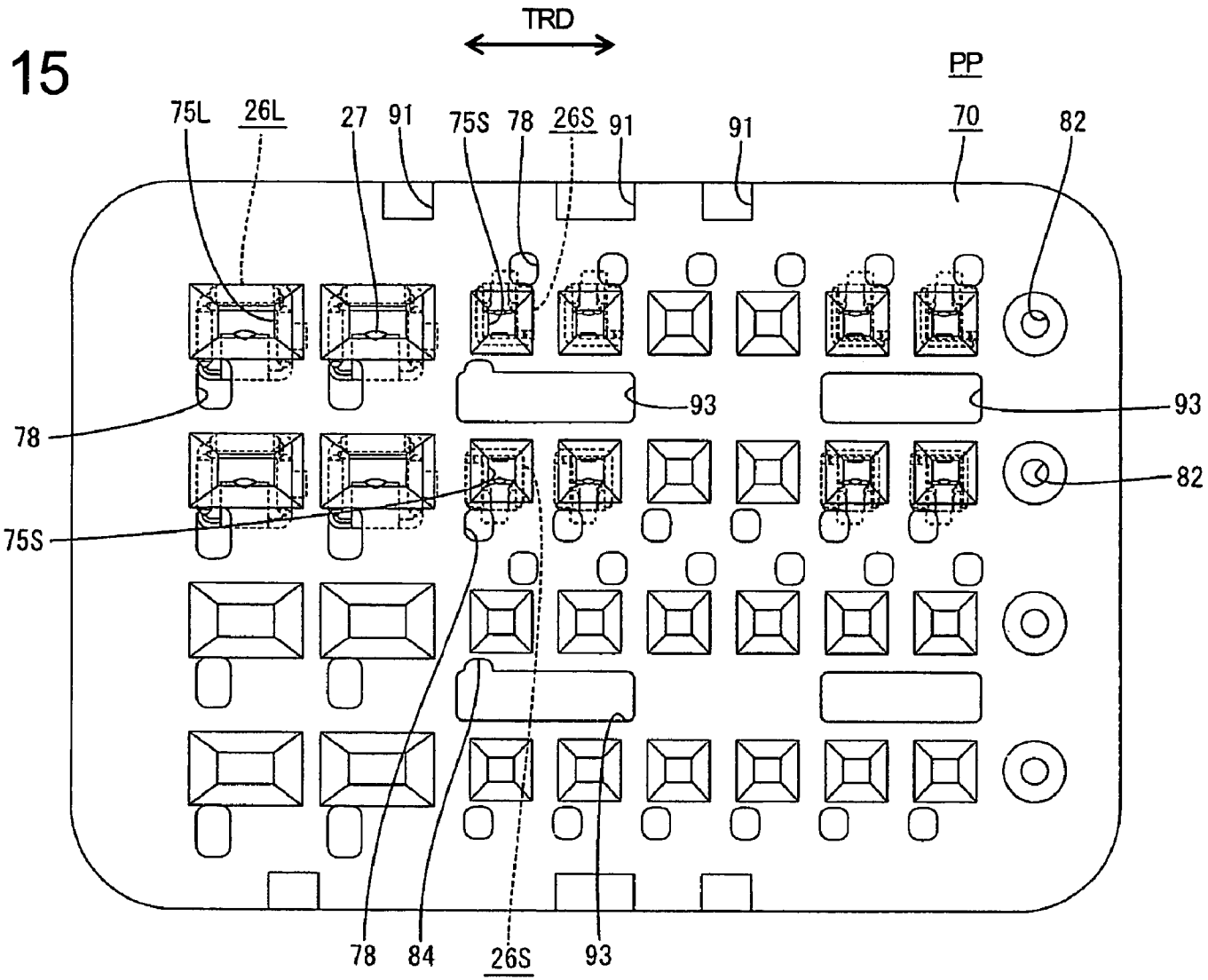
FIG. 15 is a front view showing the state of FIG. 14.
Figure 16A:
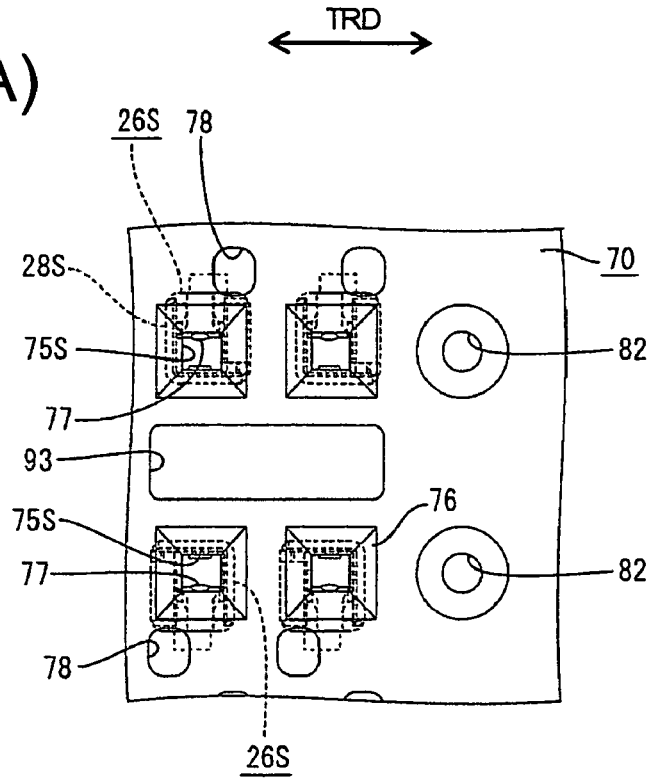
FIG. 16(A) is a partial front view showing an accommodated state of the smaller female terminals.
Figure 16B:
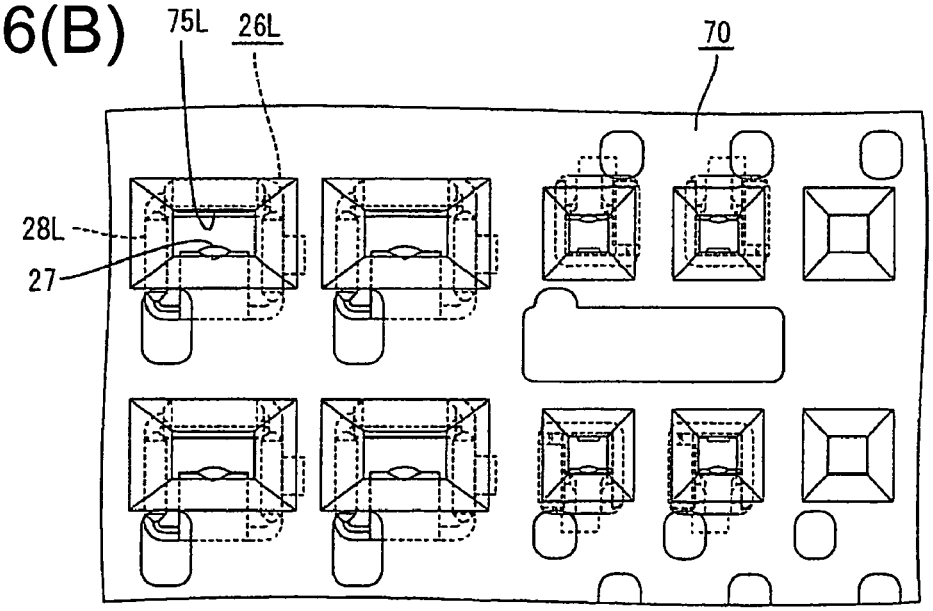
FIG. 16(B) is a partial front view showing an accommodated state of the larger female terminals.

When the front mask 70 is at the proper position PP, the respective terminal insertion openings 75 of the front plate 71 align with the front openings of the corresponding cavities 24, as shown in FIGS. 15 and 16. Thus, the tabs 14 of the mating male terminals 13 can be inserted into the cavities 24 through the terminal insertion openings 75.

Deformation spaces for the locks 25 make openings in the front surface of the terminal accommodating portion 21 upon molding the female housing 20. However, the front ends of the deformation spaces for the locks 25 are closed by the front plate 72 when the front mask 70 reaches the proper position PP. Thus, external matter cannot enter the deformation spaces to deform the locks 25 inadvertently.

Figure 14:
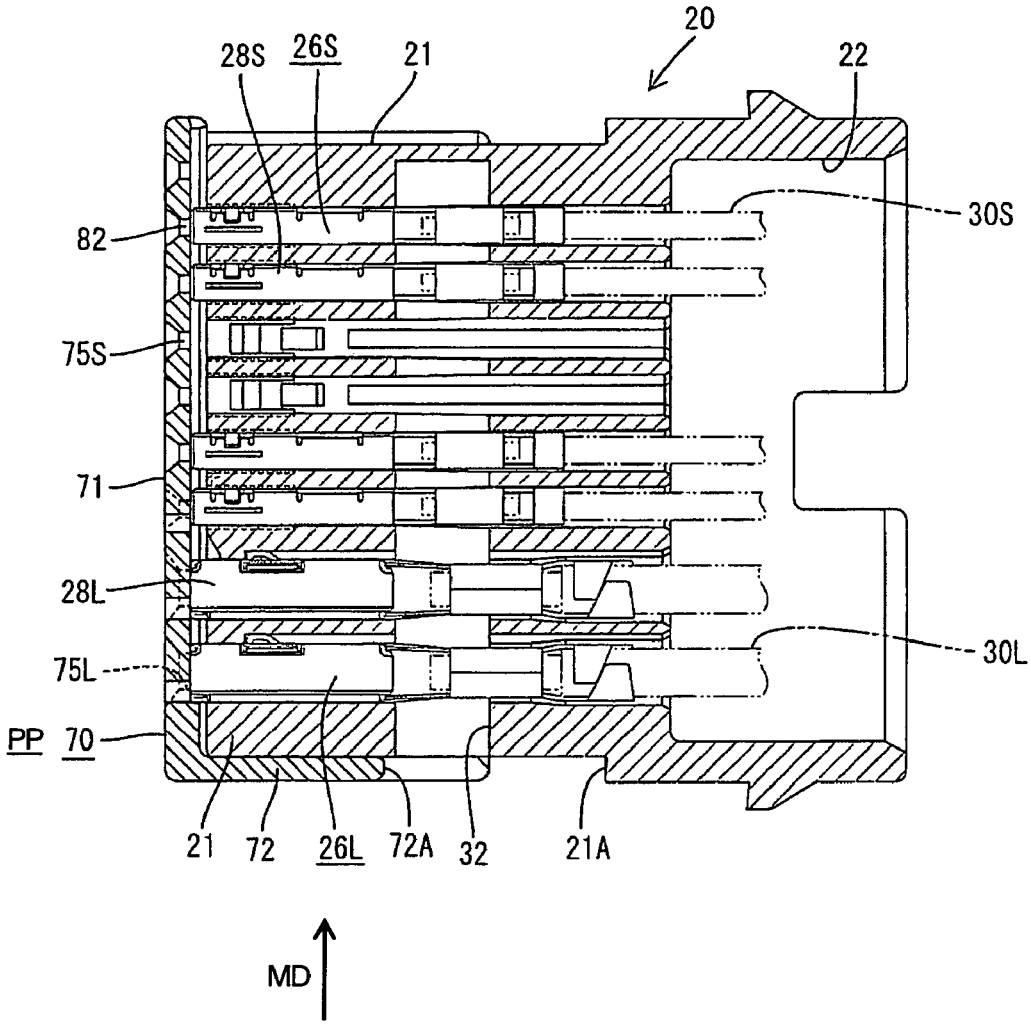
FIG. 14 is a section showing a state where the front mask is mounted at a proper position when viewed from below.

The side plate 72 of the front mask 70 functions as an operable portion when the front mask 70 is pushed from the testing position TP to the proper position PP. The side plate 72 contacts the left surface of the terminal accommodating portion 21, as shown in FIG. 14, when the front mask 70 is at the proper position PP. An escaping window 72A is formed at a rear end of the side plate 72 for exposing the retainer insertion opening 32 to the outside.

Guide grooves 91 extend substantially from the front ends of the ceiling plate 73 and the bottom plate 74 and receive the guide ribs 16 on the receptacle 12 of the male housing 10. The guide ribs 16 cannot be inserted into the guide grooves 91 until the front mask 70 is at the proper position PP.

The front plate 17 also is formed with rib insertion grooves 93 having substantially the same arrangement as the erroneous-connection preventing ribs 17 of the male housing 10. The erroneous-connection preventing ribs 17 cannot be inserted into the rib insertion grooves 93 and the rib insertion grooves 93 cannot be aligned with receiving grooves 94 in the front surface of the terminal accommodating portion 21 until the front mask 70 is at the proper position PP. The upper and lower rib insertion grooves 93 at the left side are formed with the communicating openings 84 to serve as the test openings, as described above.

The front mask 70 is to be mounted at a position immediately before the housing seal 69 to retain the housing seal 69.

The one-piece rubber plug 35 is mounted into the mounting recess 22 in the rear surface of the female housing 20, and the rear holder 40 is mounted by fitting the base 41 into the mounting recess 22 behind the one-piece rubber plug 35. The rear holder 40 is stopped when the base 41 lightly touches the rear surface of the one-piece rubber plug 35, and the locking frames 50 engage resiliently with the locking projections 51. Thus, the rear holder 40 is mounted so as not to be detached. The housing seal 69 is mounted from the front at the step 21A on the outer peripheral surface of the terminal accommodating portion 21 as the rear holder 40 is mounted. Subsequently, as shown in FIG. 10, the front mask 70 is slid in the mounting direction MD along the guide grooves 86 to cover the front of the terminal accommodating portion 21. Thus, the engaging portions 87 engage the partial locking projections 89 to hold the front mask 70 at the testing position TP. Further, the retainer 33 is inserted into the retainer insertion opening 32 and is held at the partial locking position.

The female terminals 26 secured to the ends of the wires 30 then are inserted through the respective insertion paths 43 of the rear holder 40, through the wire insertion holes 36 of the rubber plug 35, and into the corresponding cavities 24. At this time, the one-piece rubber plug 35 is not yet compressed in thickness direction TD and the wire insertion holes 36 are not yet narrowed. Thus, the female terminals 26 can be inserted with a small resistance. The locks 25 lock the female terminals 26 when the female terminals 26 contact the front plate 71 of the front mask 70, and are locked doubly by pushing the retainer 33 to the full locking position.

An electrical connection test is conducted after the female terminals 26 have been mounted. To this end, the female housing 20 is set in an electrical connection testing apparatus. The probes 80 for the small female terminals 26S then are inserted into the terminal insertion openings 75S that double as the testing openings in the front mask 70 and the exclusive testing openings 82 in the front mask 70. The probes 80 for the large female terminals 26L are inserted into the jig insertion openings 78 that double as the testing openings and through the communicating openings 84, as shown in FIG. 17.

Figure 13A:
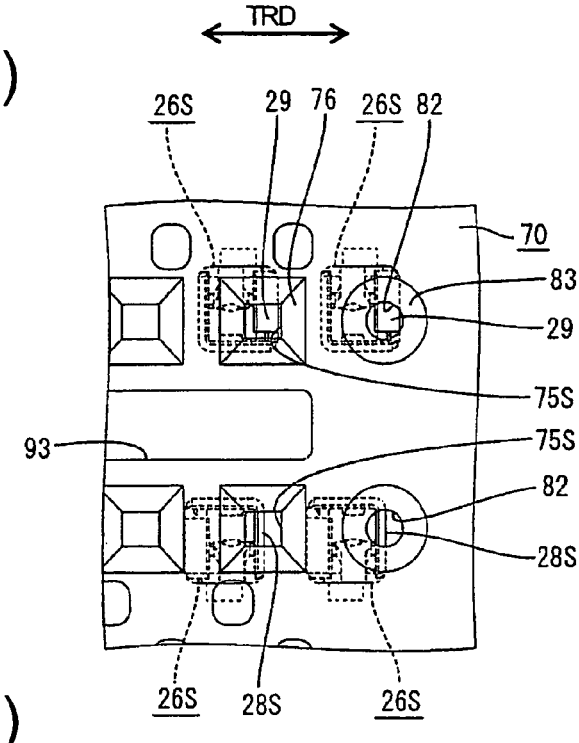
FIG. 13(A) is a partial front view showing portions designed for the electrical connection test of smaller female terminals.

At this time, as shown in FIGS. 12 and 13(A), parts of the front plates 29 of the connecting portions 28S of the smaller female terminals 26S in the rearward cavities 24S with respect to the mounting direction MD of the front mask 70 are exposed in the small terminal insertion openings 75S at the first and third stages as the testing openings, and the front plates 29 of the connecting portions 28S of the small female terminals 26S in the frontmost cavities 24S with respect to the mounting direction MD are exposed in the exclusive test openings 82 at the first and third stages. Further, the right sides of the front ends of the connecting portions 28S of the small female terminals 26S in the rearward cavities 24S with respect to the mounting direction MD are exposed in the small terminal insertion openings 75S to serve as the test openings at the second and fourth stages, and the right sides of the front ends of the connecting portions 28S of the small female terminals 26S in the frontmost cavities 24S with respect to the mounting direction MD are exposed in the exclusive testing openings 82 at the second and fourth stages.

Figure 13B:
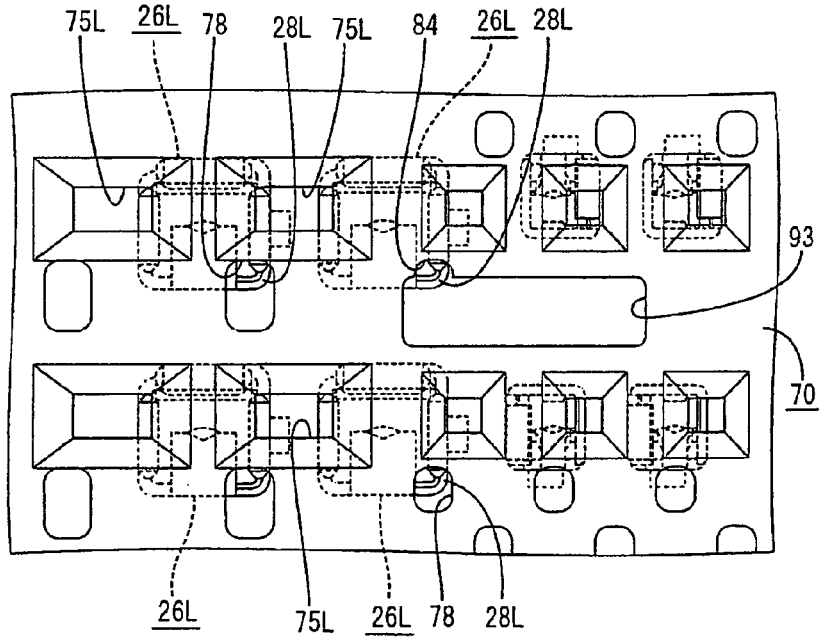
FIG. 13(B) is a partial front view showing portions designed for the electrical connection test of larger female terminals.

Further, as shown in FIG. 13(B), the bottom right corner of the front end of the connecting portion 28L of each large female terminal 26L is exposed in the jig insertion opening 78 or the communicating opening 84, which serve as the testing opening.

The guiding surfaces 76, 83 guide the probes 80 into the respective the testing openings 75S, 82 for the small female terminals 26S and into contact with the front ends of the connecting portions 28 of the female terminals 26 exposed there for the electrical connection test.

A female terminal 26 could be mounted improperly in its cavity 24. In this situation, the retainer 33 is returned to the partial locking position. The jig then is inserted into the jig insertion opening 78 of the corresponding cavity 24 to deform and unlock the lock 25. The female terminal 26 then is pulled out through the wire insertion hole 36 of the rubber plug 35 and the insertion path 36 of the rear holder 40 by pulling the wire 30. The rubber plug 35 is not compressed and the wire insertion holes 36 are not narrowed at this time. Thus, the female terminal 26 is pulled out with a relatively small resistance.

The female terminals 26 then are reinserted or their posture is corrected and the electrical connection test is conducted again.

The front mask 70 is pushed from the testing position TP to the proper position PP after the electrical connection test is completed and is held at the proper position PP by the engagement of. The engaging portions 87 engage the full locking projections 90 to hold the front mask 70 at the proper position PP. The respective terminal insertion openings 75 align with the front openings of the corresponding cavities 24 and with the front openings of the connecting portions 28 of the corresponding female terminals 26.

The wires 30 drawn out through the rear surface of the rear holder 40 are bundled and then the wire cover 65 is mounted on the rear surface of the rear holder 40. Thus, the wires 30 are bent and guided in the wire cover 65 and are drawn out through the draw-out opening 68. The lever 55 then is mounted on the outer side of the rear holder 40 at the initial position shown in FIG. 1.

The assembled female housing 20 is mated to the mating male housing 10, as shown by arrows in FIGS. 1 and 2. The guide ribs 16 of the mating receptacle 12 enter the guide grooves 91 of the front mask 70 and the followers 18 enter the entrances 60A of the cam grooves 60 of the lever 55, when the female housing 20 is fit by the specified amount shown in FIG. 18. The operable portion 56 then is pushed to rotate the lever 55 in the clockwise direction of FIG. 18. As a result, the female housing 20 is pulled to the male housing 10 by a cam action between the cam grooves 60 and the followers 18.

The erroneous-connecting preventing ribs 17 projecting from the back surface of the receptacle 12 are inserted gradually through the rib insertion grooves 93 in the front mask 70 and into the receiving grooves 94 in the front surface of the terminal accommodating portion 21 as the female housing 20 is pulled. Substantially simultaneously, the tabs 14 of the male terminals 13 projecting from the back surface of the receptacle 12 are guided by the guiding surfaces 76 into the corresponding terminal insertion openings 75 of the front mask 70. The tabs 14 then enter the cavities 24 and gradually enter the connecting portions 28 of the female terminals 26 in the cavities 24.

The erroneous-connection preventing ribs 17 of the receptacle 12 will not conform to the rib insertion grooves 93 of the front mask 70 if the female housing 20 is connected in an upside-down posture. Thus, the erroneous-connecting preventing ribs 17 contact the front surface of the front plate 71 of the front mask 70 immediately after the lever 55 is rotated, thereby hindering any further rotation of the lever 55 and indicating that the connecting posture of the female housing 20 is wrong. Similar situations occur if the female housing 20 is fit to the wrong male housing 10 or if the front mask 70 is not correctly mounted at the proper position.

Erroneous assembling of the housings 10, 20 and erroneous mounting of the front mask 70 may also be detected based on whether the guide ribs 16 of the receptacle 12 and the guide grooves 91 of the front mask 70 can engage at the start of the connecting operation of the housings 10, 20. This detection utilizing the erroneous-connecting preventing ribs 17 is a guarantee for cases where no detection is made utilizing the guide ribs 16.

The two housings 10, 20 may be connected again after the erroneous assembling of the two housings 10, 20 is detected.

The front surface of the front mask 70 contacts the back surface of the receptacle 12 when the lever 55 is rotated to move the followers 18 to positions immediately before the ends of the cam grooves 60, thereby hindering any further approaching movements of the two housings 10, 20. In this state, the tabs 14 of the mating male terminals 13 are inserted to the proper depth in the connecting portions 28 of the respective female terminals 26 and the terminals 13, 26 are connected electrically.

Figure 19:
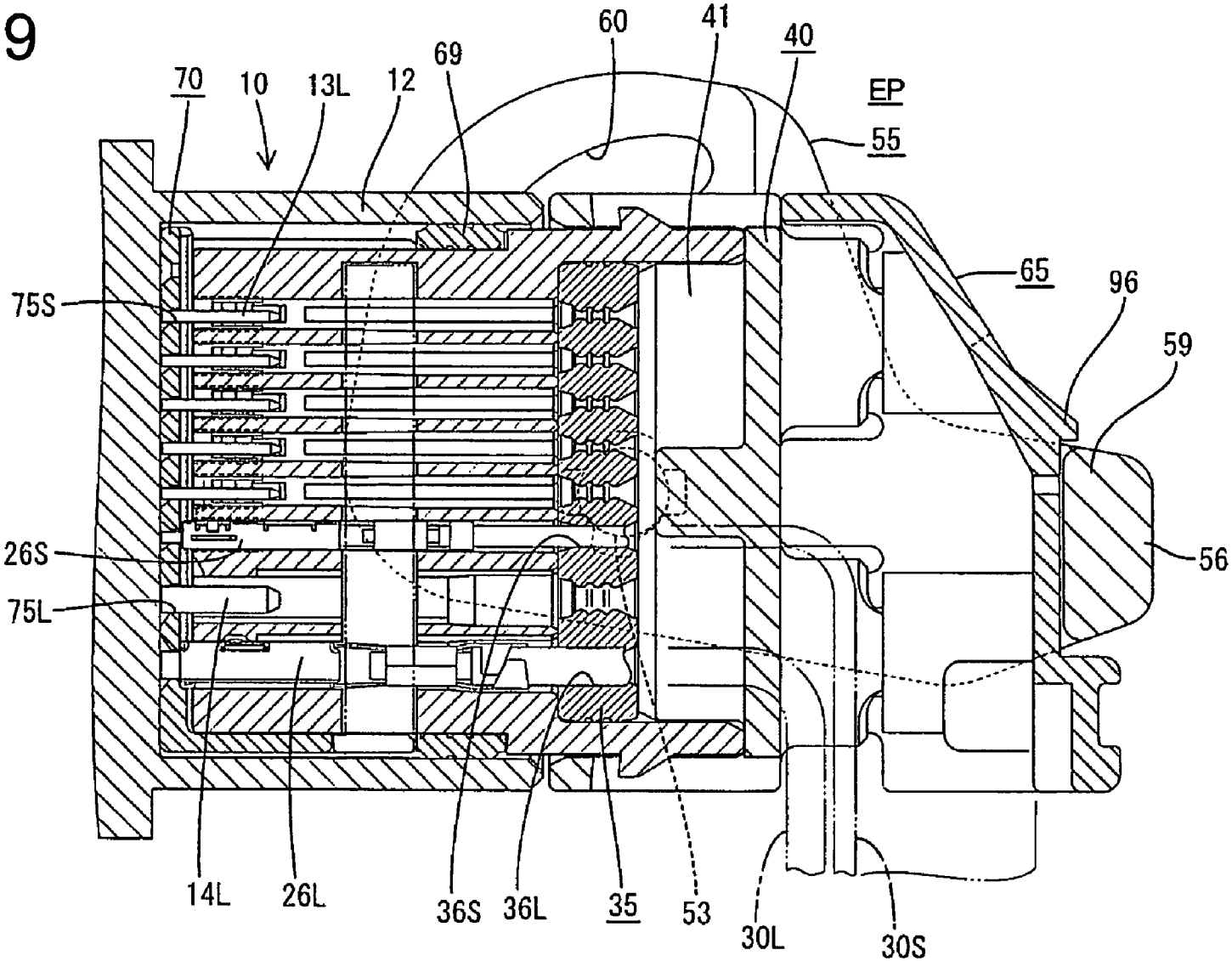
FIG. 19 is a section showing a locked state of a lever when viewed from below.

Further rotation of the lever 55 moves the rear holder 40 forward and presses the base 41 against the rear surface of the rubber plug 35, as shown in FIG. 19. Thus, the one-piece rubber plug 35 is compressed in the thickness direction TD and, as a result, the wire insertion holes 36 are narrowed to be brought into close contact with the wires 30 in radially inward directions, i.e. strong sealing is given. An interlocking portion 59 at the rear edge of the lever 55 resiliently engages a lever lock 96 on the wire cover 65 when the lever 55 is rotated to the ending position EP, thereby preventing the returning operation of the lever 55 and the separation of the two housings 10, 20.

As described above, the electrical connection test is conducted with the front mask 70 held temporarily at the testing position TP. Thus, the probes 80 can be inserted into all of the small terminal insertion openings 75S formed in the front mask 70 excluding the rearmost ones with respect to the mounting direction MD of the frame mask 70 and also into the exclusive testing openings 82 for the small female terminals 26S. The front ends of the connecting portions 28S of the small female terminals 26S in the cavities 24S located behind the corresponding cavities 24S are exposed in these small terminal insertion openings 75S. The parts of the front ends of the connecting portions 28S of the small female terminals 26S in the frontmost cavities 24S are exposed in the exclusive testing openings 82. The electrical connections of the small female terminals 26S are tested by the contact of the inserted probes 80 with the front ends of the connecting portions 28S of the small female terminals 26S. In other words, the probes 80 contact the front ends of the connecting portions 28S of the small female terminals 26S, but cannot enter the connecting portions 28S and damage the resilient contact pieces 27 in the connecting portions 28S.

The probes 80 also can be brought into contact with the corners of the front ends of the connecting portions 28L of the large female terminals 26L, thereby being similarly hindered from entering the connecting portions 28L.

The exclusive test openings 82 for the small female terminals 26S have unique shapes that are distinguishable from the small terminal insertion openings 75S. Thus the number of the small terminal insertion openings 75S, i.e. the number of contacts can be determined from the external appearance.

The female housing 20 is fitted to the mating male housing 10 with the front mask 70 at the proper position PP. The erroneous-connection preventing ribs 17 engage the rib insertion grooves 93 If the two housings 10, 20 correctly conform to each other, and connection of the two housings 10, 20 can be completed. However, the erroneous-connection preventing ribs 17 cannot engage the rib insertion grooves 93 and the two housings 10, 20 cannot be connected if one of the two housings 10, 20 is in a wrong posture, e.g. upside-down, or if the housings 10, 20 do not conform. Thus, erroneous assembling can be detected.

Even if the two housings 10, 20 correctly conform to each other, the erroneous-connection preventing ribs 17 and the rib insertion grooves 93 cannot be engaged if the front mask 70 is not at the proper position PP. Therefore, the mounted state of the front mask 70 can also be detected.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The shape of the exclusive testing openings for the small female terminals is not limited to the round shape shown in the foregoing embodiment, and may be, for example, a triangular or hexagonal shape. In short, any shape is sufficient provided that it is different from the front shape of the small terminal insertion openings.

Different shapes for the exclusive testing openings and the small terminal insertion openings enable the number of contacts to be determined. However, they may have the substantially same front shape. Such testing openings are embraced by the technical scope of the invention.

The invention is not limited to hybrid connectors in which terminal fittings having different sizes are accommodated in the same housing, and is applicable to connectors accommodating terminal fittings of one size. For example, if only the smaller female terminals are accommodated in this embodiment, the electrical connection test by the probes can be conducted, utilizing the terminal insertion openings and the exclusive testing openings for all the female terminals.

The electrical connection test can be conducted only utilizing the terminal insertion openings and the exclusive testing openings, for example, by suitably setting intervals of the cavities, i.e. the terminal insertion openings formed in the front mask even if the connector is of the hybrid type.

The invention is applicable to connectors with no lever or other types of movable members, such as sliders and/or non-watertight connectors.

What is claimed is:

1. A connector comprising:

a housing having a terminal accommodating portion with opposite front and rear ends and cavities extending from the rear end to the front end;

female terminals accommodated respectively in the cavities, each female terminal having a connecting portion connectable with a tab of a male terminal, the connecting portion having a front end;

a front mask mounted on the front end of the terminal accommodating portion and being movable along a mounting direction from a test position to a proper position, the front mask being formed with terminal insertion openings dimensioned for receiving the tabs of the male terminals, the front mask further being formed with a testing opening, the terminal insertion openings being aligned for inserting the tabs of the male terminals through the terminal insertion openings and into the connecting portions of the female terminals in the respective cavities when the front mask is at the proper position, an offset position of a frontmost cavity with respect to the mounting direction being exposed at the testing opening when the front mask is at the test position and offset positions of the front ends of the connecting portions of all other of the female terminals in the cavities being exposed in the terminal insertion openings when the front mask is at the test position, whereby probes for an electrical connection test can engage the offset positions of the connecting portions when the front mask is at the test position.

2. The connector of claim 1, wherein slanted guiding surfaces are formed over substantially an entire periphery of each of the terminal insertion openings.

3. The connector of claim 1, wherein the front mask has at least one erroneous-assembling preventing portion engageable with a mating erroneous-assembling preventing portion on a connecting surface of a mating housing when the front mask is at the proper position.

4. The connector of claim 1, wherein a resilient plug is mounted at a rear surface of the housing and is retained by a rear holder.

5. The connector of claim 1, wherein a movable member is provided on the housing to assist a connection of the housing with the mating housing by displaying a cam action when being operated.

6. The connector of claim 1, wherein front mask forms at least part of a front wall of each cavity.

7. The connector of claim 6, wherein the mounting direction of the front mask is along an arranging direction of the cavities.

8. The connector claim 7, wherein the test position is before the proper position with respect to the mounting direction.

9. The connector of claim 6, wherein the terminal insertion openings and the test opening have different front shapes.

10. A method of assembling a connector, comprising:

providing housing with a terminal accommodating portion and cavities formed in the terminal accommodating portion, accommodating female terminals into the cavities, the female terminals having connecting portions connectable with tabs of mating male terminals in the respective cavities, providing a front mask formed with terminal insertion openings and with a test opening, the terminal insertion openings being arranged at positions for aligning with the respective cavities, positioning the front mask at a test position on the front surface of the terminal accommodating portion so that part of the front end of the connecting portion of the female terminal in one of the cavities is partly exposed in the test opening and so that parts of the front ends of the connecting portions of the female terminals in the other cavities are partly exposed in the terminal insertion openings, inserting probes for an electrical connection test through the test opening and through the terminal insertion openings for contacting the partly exposed front ends of the connecting portions of the female terminals, moving the front mask to a proper position so that the terminal insertion openings are aligned for inserting tabs into the connecting portions of the female terminals.

* * * * *